US006976410B2

(12) United States Patent
Anderson et al.

(10) Patent No.: US 6,976,410 B2
(45) **Date of Patent: *Dec. 20, 2005**

(54) TOOL BIT DRIVE ADAPTOR

(75) Inventors: Craig Anderson, Gresham, OR (US); Howard G. Berg, Gresham, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/922,389

(22) Filed: Aug. 19, 2004

(65) Prior Publication Data

US 2005/0011010 A1 Jan. 20, 2005

Related U.S. Application Data

(63) Continuation of application No. 10/443,475, filed on May 22, 2003, now Pat. No. 6,779,212, which is a continuation of application No. 09/952,494, filed on Sep. 11, 2001, now Pat. No. 6,578,222, which is a continuation of application No. 09/459,742, filed on Dec. 10, 1999, now Pat. No. 6,289,541, which is a continuation of application No. 08/785,525, filed on Jan. 17, 1997, now Pat. No. 6,000,080.

(51) Int. Cl.[7] ..... B25B 7/22
(52) U.S. Cl. ..... 81/128; 7/138; 81/438
(58) Field of Search ..... 7/125, 127, 128, 7/138, 165; 81/438, 450, 177.8, 177.9

(56) References Cited

U.S. PATENT DOCUMENTS

| | | | |
|---|---|---|---|
| 243,652 | A | 6/1881 | Straszer |
| 1,010,631 | A | 12/1911 | Holmquist |
| 1,321,777 | A | 11/1919 | Stepanian |
| 1,384,887 | A | 7/1921 | Burndahl |
| 1,402,391 | A | 1/1922 | Baldus |

(Continued)

FOREIGN PATENT DOCUMENTS

DE 33 24 637 A1 2/1984

OTHER PUBLICATIONS

Gerber Multi-Plier Tool Kit Coupler Instruction Sheet. At least as early as Dec. 1993.

(Continued)

*Primary Examiner*—Hadi Shakeri
(74) *Attorney, Agent, or Firm*—Chernoff, Vilhauer, McClung & Stenzel, LLP

(57) ABSTRACT

An adaptor to mate with a hand tool such as a folding multipurpose tool to make use of the multipurpose tool as a handle to turn tool bits of various sizes, such as screwdrivers or small socket wrenches. The adaptor includes a drive plate which mates with the hand tool, and a tool bit-engaging member attached to the drive plate and movable angularly between various positions, with a latch to keep the tool bit-engaging member in a selected position. A pair of arms of the drive plate engage the sides of the jaws of one type of multipurpose tool to locate the adaptor as required with respect to the multipurpose tool.

9 Claims, 5 Drawing Sheets

U.S. PATENT DOCUMENTS

| | | | |
|---|---|---|---|
| 1,640,426 | A | 8/1927 | Pike |
| 1,748,673 | A | 2/1930 | Hurst |
| 4,122,569 | A | 10/1978 | Hitchcock |
| 4,238,862 | A | 12/1980 | Leatherman |
| D297,609 | S | 9/1988 | Bellon |
| 4,888,869 | A | 12/1989 | Leatherman |
| 5,018,411 | A | 5/1991 | La Padura |
| 5,245,721 | A | 9/1993 | Lowe et al. |
| 5,251,353 | A | 10/1993 | Lin |
| 5,280,659 | A | 1/1994 | Park |
| 5,320,004 | A | 6/1994 | Hsiao |
| 5,327,602 | A | 7/1994 | Stenger |
| 5,432,968 | A | 7/1995 | Beck |
| 5,513,544 | A | 5/1996 | Winkler et al. |
| 5,515,754 | A | 5/1996 | Elkins |
| 5,544,379 | A | 8/1996 | Chen |
| 6,000,080 | A | 12/1999 | Anderson et al. |
| 6,289,541 | B1 | 9/2001 | Anderson et al. |
| 6,578,222 | B2 | 6/2003 | Anderson et al. |
| 6,779,212 | B2 | 8/2004 | Anderson et al. |

OTHER PUBLICATIONS

Wenger, WengerGrip Series Instruction Sheet. At least as early as 1996.

TOOL BIT DRIVE ADAPTOR

This application is a continuation of U.S. patent application Ser. No. 10/443,475, filed May 22, 2003, now U.S. Pat. No. 6,779,212, which is a continuation of U.S. patent application Ser. No. 09/952,494, filed Sep. 11, 2001, now U.S. Pat. No. 6,578,222, which is a continuation of U.S. patent application Ser. No. 09/459,742, filed Dec. 10, 1999, now U.S. Pat. No. 6,289,541, which is a continuation of U.S. patent application Ser. No. 08/785,525, filed Jan. 17, 1997, now U.S. Pat. No. 6,000,080.

BACKGROUND OF THE INVENTION

The present invention relates to hand tools, and in particular to an adaptor for use with pliers or multipurpose hand tools to turn screwdriver bits, small socket wrenches, and the like.

It is well known to use a single handle to drive a selected one of a set of screwdriver bits or wrenches of various sizes, to save the cost of having several handles. It is also often desirable thus to minimize the weight and number of tools used or carried. Adaptors intended to be gripped by drill chucks are also available to receive such bits. Some multipurpose hand tools previously available have also included drive members for driving small socket wrenches. Some of these drives, while useful, add undesirably to the size of the multipurpose tools of which they are part, making the multipurpose tools less convenient to carry.

Folding multipurpose tools are disclosed, for example, in Leatherman U.S. Pat. Nos. 4,238,862, and 4,888,869. Many generally similar tools are available.

Most such multipurpose tools do not include more than two or three sizes of straight screwdriver blades and one or two sizes of Phillips screwdrivers. Such multipurpose tools do not usually include any socket wrench drives, and thus they are not readily useful to drive many of the various different types or sizes of screwdriver bits and socket wrenches available. However, it would be advantageous to be able to drive such screwdriver bits, socket wrenches or other small tools using an available multipurpose tool as a drive handle. This would be particularly advantageous to avoid carrying several special drive handles where it is important to minimize the weight of tools carried, as in bicycle touring.

Depending on the space available around a screw, bolt, or nut it may be necessary or desirable for a socket or screwdriver to be adjustable optionally to be aligned with a handle or to extend at an angle to one side. While some adaptors have been available previously to enable screwdrivers or small socket wrenches to be driven by a folding multipurpose tool, these arrangements have not been strong enough, or have been limited to axially aligned engagement with a screwdriver included in a multipurpose tool, or have been otherwise limited in their usefulness.

What is needed, then, is a suitably strong adaptor by which various small tool bits, screwdrivers, or sockets can be driven, using another hand tool as a handle for the adaptor, and with which such tool bits can be aligned at selected angles with respect to the hand tool. Preferably, such an adaptor could be used with multipurpose tools such as those which are already well known and widely available and would be small enough to be carried conveniently.

SUMMARY OF THE INVENTION

The present invention overcomes the aforementioned shortcomings of the prior art and supplies an answer to the need for a small and easily used, but strong, adaptor to enable various tool bits to be driven by a single hand tool.

As used herein a tool bit means a screwdriver bit or a small wrench socket, or a similar tool which may be one of a set of such tools of several sizes, all of which can be driven in rotation when mated with a suitable drive member. An adaptor according to the present invention includes a drive plate having a driven end and a driving end, with a tool bit-engaging member attached to the drive plate near its driving end. A pair of generally parallel arms are included at the driven end of the drive plate and are available to engage or be engaged by a hand tool which is to be used as a handle for the adaptor.

In one embodiment of the present invention the tool bit-engaging member includes a hexagonal socket of an appropriate size for receiving the shanks of interchangeable screwdriver bits and other tool bits of the same size.

In a preferred embodiment of the invention the tool bit-engaging member is able to pivot with respect to the drive plate, between an in-line orientation and an offset or angled position.

Another aspect of the invention is a locking mechanism provided to hold the tool bit-engaging member in an in-line orientation or in a selected angled orientation with respect to the drive plate when the adaptor is being used. In one such locking mechanism a spring-loaded tooth engages a selected notch on the drive plate, while a collar surrounding the body of the tool bit-engaging member keeps the tooth aligned and is useful to disengage the tooth from a notch.

Preferably, the driven end of the drive plate includes a projection arranged to engage a handle of a multipurpose tool to keep the adaptor securely mated with the multipurpose tool.

In one embodiment of the invention, the parallel arms defined on the driven end of the adaptor drive plate are arranged to fit snugly along opposite sides of a pair of jaws of a multipurpose tool with which the adaptor is mated.

A feature of one embodiment of the invention is a stiffener portion of the drive plate that increases the amount of torque that can be transmitted to a tool bit in an offset or angled position.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figures 1, 2:
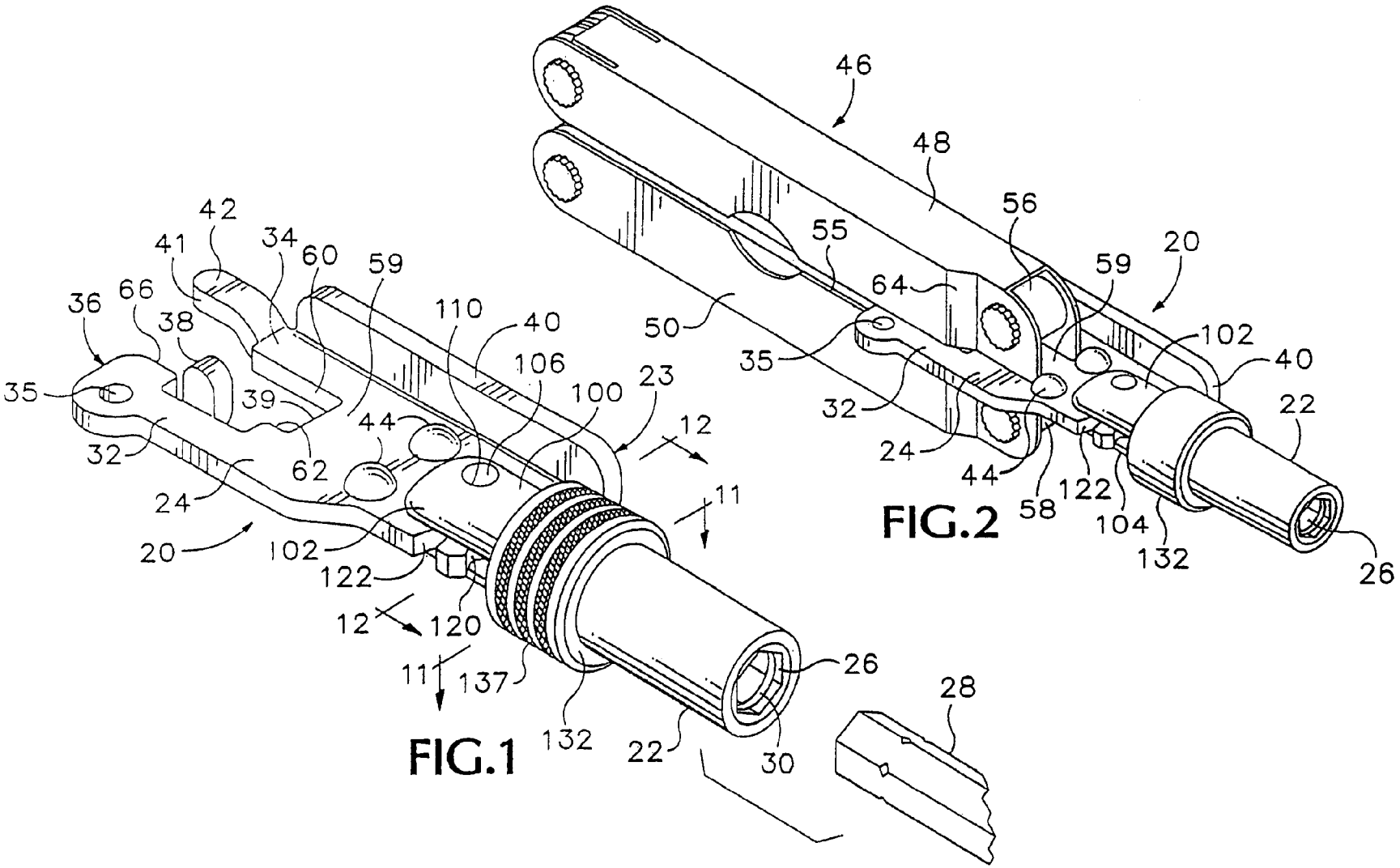
FIG. 1 is a perspective view of a tool bit drive adaptor according to the present invention, together with a portion of a tool bit.
FIG. 2 is a perspective view of the tool bit drive adaptor shown in FIG. 1 in place between the handles of a folding multipurpose tool.

Referring to FIGS. 1–6 of the drawings which form a part of the disclosure herein, a tool bit drive adaptor 20 includes a tool bit-engaging member 22 attached to a driving end 23 of a drive plate 24. A hexagonal socket 26 is defined in an outer, or driving, end of the tool bit-engaging member 22 to receive a hexagonal end or base 28 of a tool bit which may be a screwdriver or a wrench belonging to a set of similar screwdrivers or wrenches all having bases of a size to fit the socket 26, so that a single handle may be used to drive any of the screwdrivers or wrenches.

Within the socket 26, a circular spring 30 is located within a radial groove deep enough to allow the circular spring 30 to expand to permit the base 28 of the screwdriver or other tool bit to enter into the socket 26, after which the elastic grip of the spring 30 helps to retain the base 28 within the socket 26.

The drive plate 24 includes a pair of substantially parallel fork arms 32 and 34, located at a driven end 36 of the drive plate 24 and defining a jaw-receiving throat 39 between them. A hole 35 is provided in the fork arm 32 to receive a lanyard to keep the adaptor 20 handy. The drive plate 24 is formed as by stamping or pressing an appropriately shaped unitary blank cut from a sheet of metal such as steel of an appropriate thickness, for example 0.094 inch. A retaining tab 38 is bent to extend generally perpendicularly upward from the fork arm 32, and a portion of the drive plate 24 is bent similarly upward to form a stiffener 40 extending along the length of the drive plate 24 including the fork arm 34. The stiffener 40 may have a width 41 of about 0.25 inch, for example. Provision of the stiffener 40 adds significantly to the ability of the adaptor 20 to transmit torque to a tool bit without damage to or failure of the drive plate 24, particularly when the tool bit-engaging member is in an angled position rather than in line with the length of the drive plate 24.

Figure 5:
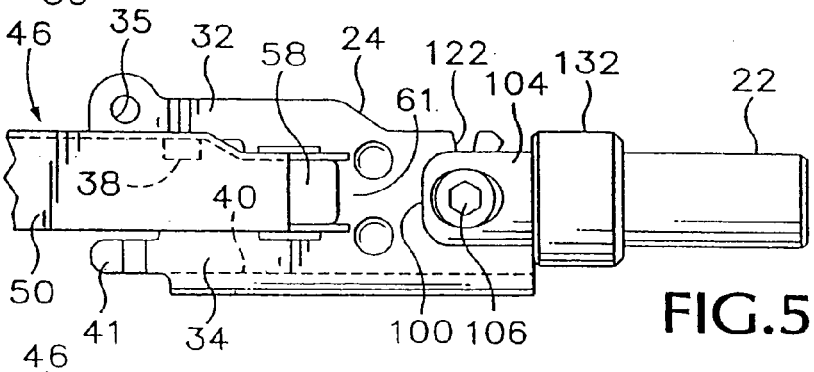
FIG. 5 is a bottom view of the tool bit drive adaptor and portion of a multipurpose tool shown in FIG. 4.
Figure 6:
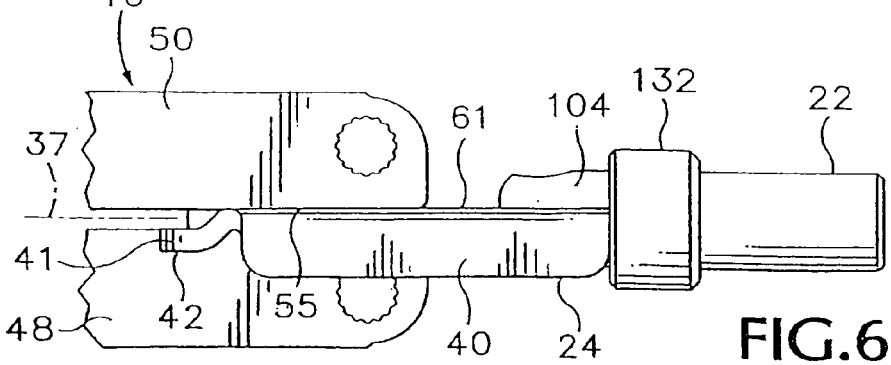
FIG. 6 is a view of the tool bit drive adaptor and portion of a multipurpose tool shown in FIG. 4, rotated 180° about a longitudinal axis of the tool bit drive adaptor to show the opposite side from that shown in FIG. 4.
Figure 8:
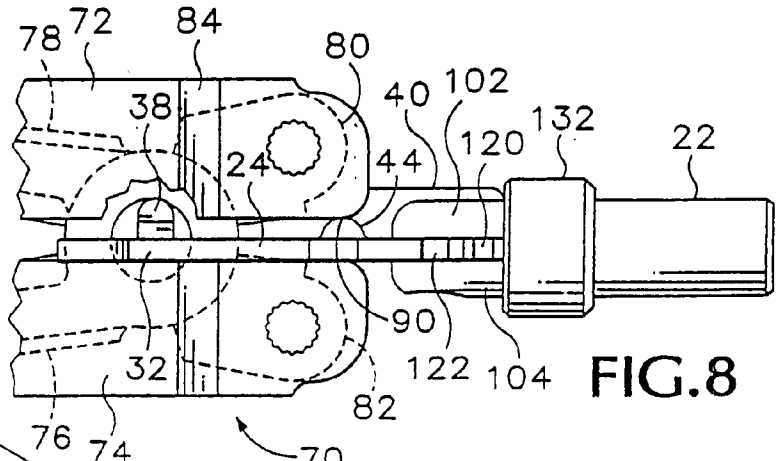
FIG. 8 is a view similar to that of FIG. 4, showing the position of the tool bit drive adaptor relative to the positions of the handles and jaws of the multipurpose tool shown in FIG. 7.

As may best be seen in FIGS. 1, 5, and 6, an outer end portion of the fork arm 34 is offset slightly out of the principal plane 37 of the drive plate 24 to act as a spacer 41 having an upper, or spacer surface 42 whose function will be explained presently. A pair of spacer bumps 44 are also provided in the drive plate 24 near its driving end 23, extending upward away from its bottom surface 61, and may be formed by stamping or coining the blank as a part of the process of manufacturing the drive plate 24.

Figure 3:
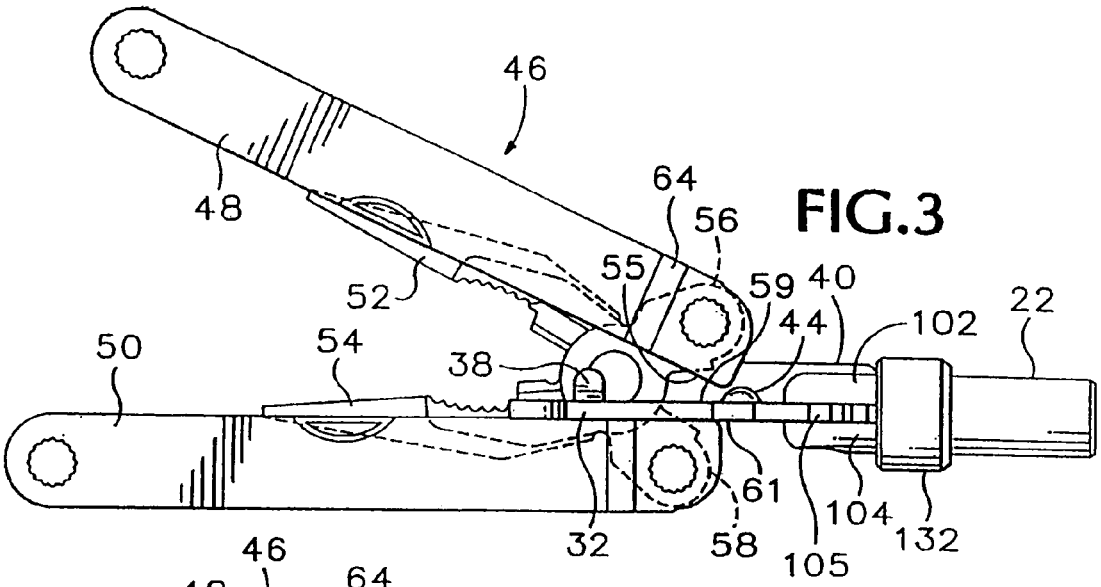
FIG. 3 is a side elevational view of the folding multipurpose tool and tool bit drive adaptor shown in FIG. 2, with the handles and jaws of the folding multipurpose tool partially separated from each other.
Figure 4:
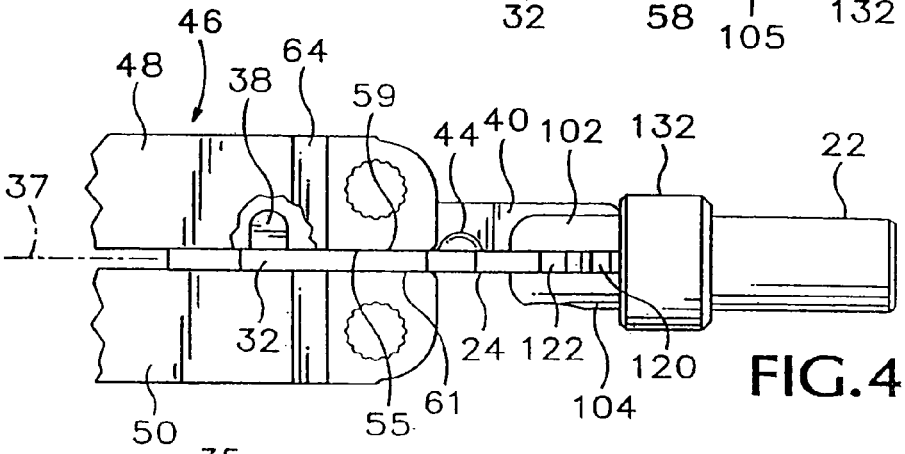
FIG. 4 is a side elevational view, at an enlarged scale, of the tool bit drive adaptor shown in FIG. 3, together with a portion of the folding multipurpose tool, shown partially cut away.

As shown in FIGS. 2 and 3, the adaptor 20 is used with a multipurpose folding tool such as a Leatherman® Pocket Survival Tool™ 46 which includes a pair of folding handles 48, 50 of sheet metal channel construction. The tool 46 also includes a pair of interconnected jaws 52 and 54 each having a respective base 56, 58 about which one of the handles 48, 50 can rotate, between a folded position shown in FIGS. 2 and 3 and an extended position (not shown) in which the handles 48, 50 extend from the bases 56, 58 for operation of the jaws 52, 54. An inner surface 60 of the fork arm 34 extends closely alongside the pivotally interconnected portions of the jaws 52, 54 of the Leatherman® Pocket Survival Tool™ 46, and inner surfaces 62 and 66 extend closely alongside portions of the opposite side of the pivotally interconnected portions of the jaws 52, 54, visible in FIG. 3. Opposed marginal surfaces 55 of the handles 48 and 50 also rest upon opposite faces 59 and 61 of the drive plate 24, in contact therewith adjacent the throat 39. The spacer portion 41 extends alongside the handle 48, and the marginal surfaces 55 of the handles 48, 50 rest upon or close to the opposite faces 59 and 61 of the drive plate 24 along both of the legs 32 and 34. At the same time, as shown in FIGS. 3 and 4, the retaining tab 38 extends within the handle 48, whose shape includes an inward jog defining an angled face 64, so that the retaining tab 38 prevents the drive plate 24 from being withdrawn from its position between the handles 48, 50, and bases 56, 58 of jaws 52, 54, while the throat 39 defined between the fork arms 32 and 34 rests against the pivotally interconnected portions of the jaws 52, 54. The location of the drive plate 24 is thus precisely established with respect to the jaws 52, 54 and the handles 48 and 50.

Figure 7:
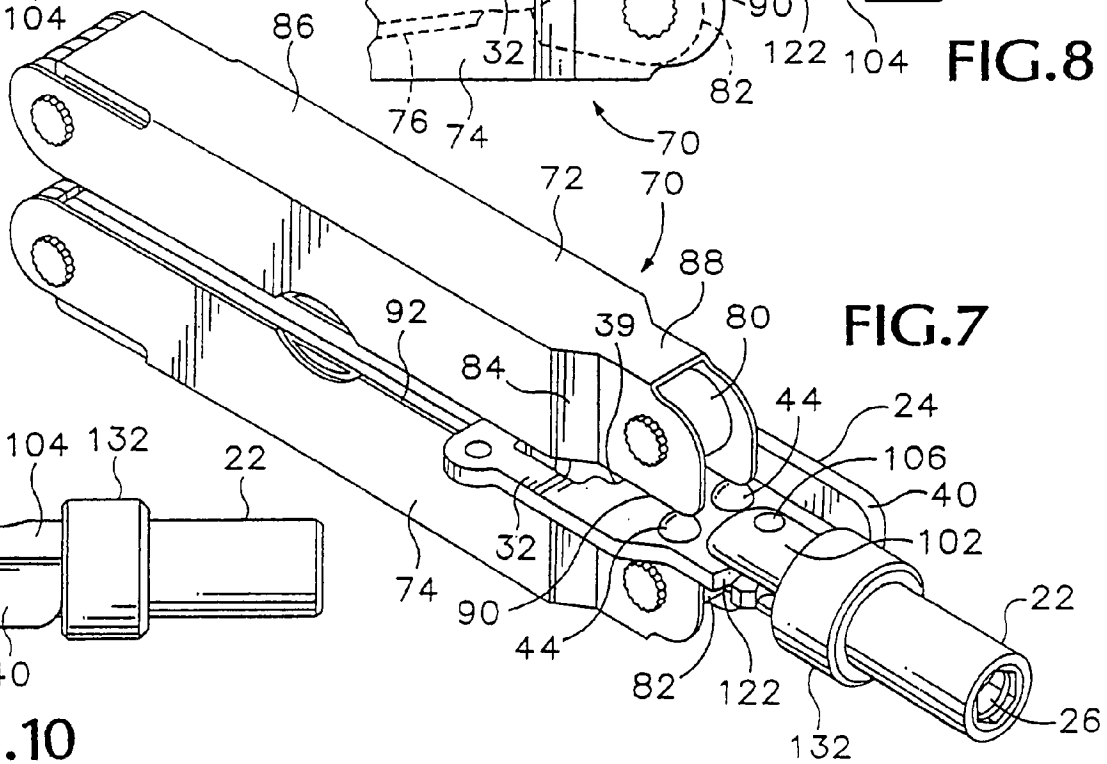
FIG. 7 is a perspective view of the tool bit drive adaptor shown in FIG. 1, together with a folding multipurpose tool of a somewhat larger size than the multipurpose tool shown in FIG. 2.
Figure 9:
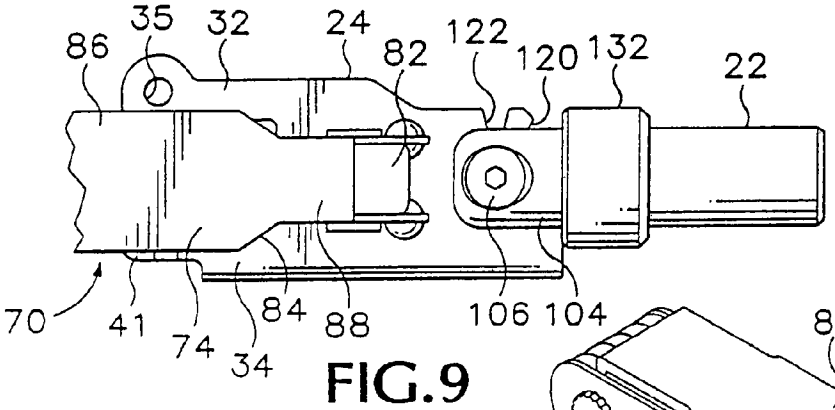
FIG. 9 is a bottom plan view of the tool bit drive adaptor, together with a portion of the multipurpose tool shown in FIG. 7.
Figure 10:
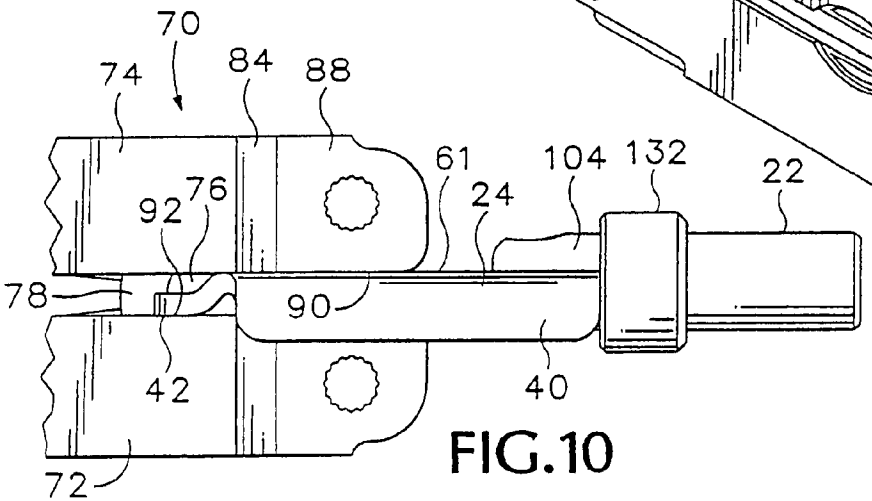
FIG. 10 is a view similar to that of FIG. 6, showing the tool bit drive adaptor of the invention together with the multipurpose tool shown in FIG. 7.

Referring next to FIGS. 7, 8, 9, and 10, a larger multipurpose tool 70, such as a Leatherman® Super Tool™, has a pair of handles 72 and 74 of sheet metal channel construction and a pair of pivotally interconnected jaws 76 and 78, each having a base 80, 82 about which a respective one of the handles 72, 74 can rotate between a folded position as shown in FIG. 7 and an extended position (not shown). The drive plate 24 of the adaptor fits around the jaws 76 and 78 between their bases 80, 82 and between the handles 72 and 74 in much the same way in which it fits around the jaws 52 and 54 in the multipurpose tool 46 as described above, but since the handles 72 and 74 are wider and longer than the handles 48 and 50, they extend over a greater portion of the drive plate 24, as may be seen in FIGS. 7, 8, 9, and 10. An angled face portion 84 on each side of each handle 72 and 74 interconnects a wider portion 86 of each handle with a narrower portion 88, where the respective jaw 76 or 78 is located. The retaining tab 38 extends upward within the handle 72 in position to contact the inner side of the angled portion 84 to retain the drive plate 24 in place with respect to the handle 72. The narrower portion 88 of each of the handles 72, 74 extends beyond the angled portion 84 on each side, and the inwardly facing margins 90 of the narrower portion 88 of the handle 72 rest against the spacer bumps 44, while a part of the margin 92 of the wider portion 86 of the handle 72 rests against the spacer surface 42, as shown best in FIG. 10.

At the same time, the corresponding margins 90 and 92 of the other or bottom handle 74 extend closely parallel with the bottom surface 61 of the drive plate 24, and the base 82 of the jaw 78, adjacent the pivotally interconnected portions of the jaws 76, 78, presses against the bottom surface 61 of the drive plate 24 adjacent the throat 39. The bottom surface 61 thus acts as a spacer in opposition to the spacer surface 42 and spacer bumps 44. The margin 92 of the handle 72 also presses against the spacer surface 42, counterbalancing the forces of the margins 90 against the spacer bumps 44 and keeping the handle 72 parallel with the principal plane 37 of the drive plate 24 and with the bottom handle 74. Pressure on the handle 74 thus squeezes the base 82 of the jaw 78 against the bottom surface 61, while pressure against the upper handle 72 presses its margins 90, 92 against the spacer bumps 44 and spacer surface 42, so that a firm grip squeezing the handles 72 and 74 together holds the drive plate 24 firmly between the handles 72 and 74 to provide a solid interconnection of the multipurpose tool 70 to the adaptor 20.

With the handles 72 and 74 so located the inner surface 60 of the fork arm 34 rests snugly alongside the pivotally interconnected portions of the jaws 76 and 78, while the inner surfaces 62 and 66 of the fork arm 32 rest snugly along the pivotally interconnected portions of the jaws 76 and 78 on the opposite side of the multipurpose tool 70.

Figure 11:
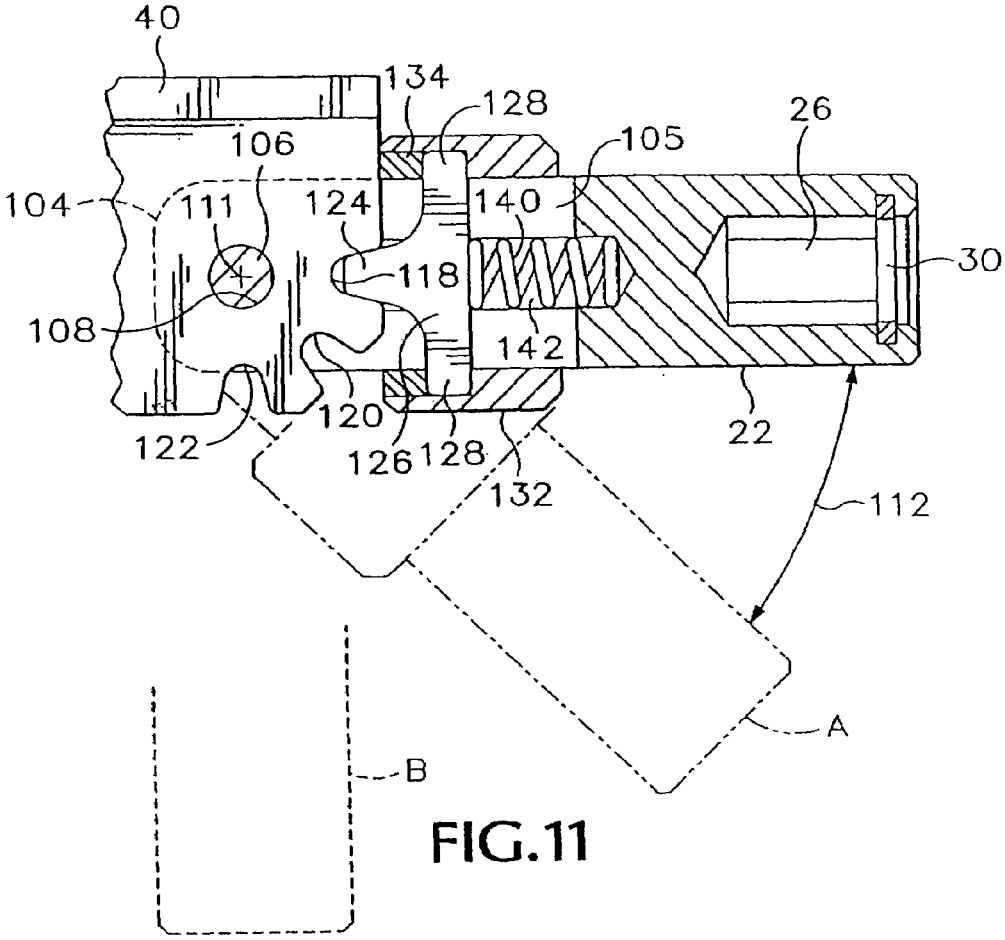
FIG. 11 is a sectional view of a portion of the tool bit drive adaptor shown in FIGS. 1–10, taken along line 11—11 of FIG. 1.

Referring now also to FIG. 11, the tool bit-engaging member 22 has a body that is generally cylindrical in shape and includes a base portion 100 having a top leg 102 and a bottom leg 104, defining between them a slot 105 which snugly receives the driving end portion 23 of the drive plate 24. The tool bit-engaging member 22 is attached to the drive plate 24 by an attachment screw 106 that extends through a hole defined in the bottom leg 104 and a pivot hole 108 defined in the drive plate 24, and is engaged in a threaded bore 110 defined in the top leg 102. The tool bit-engaging member 22 is thus able to be pivoted about the axis 111 of the screw 106 with respect to the drive plate 24, between an in-line position as shown in FIG. 1 and a position in which the tool bit-engaging member 22 extends away from such an in-line position at an angle 112.

The tool bit-engaging member 22 is ordinarily kept located in the in-line position, or in either of a pair of optional offset-angled positions A, B shown in FIG. 11, by a locking device incorporated in the adaptor 20. Three notches 118, 120, 122 are defined in the outer margin of the drive plate 24, at positions separated from one another by angles of 45° about the central axis 111 of the screw 106, as may be seen best in FIG. 11. When the tool bit-engaging member 22 is aligned with the drive plate 24 in the in-line position previously mentioned, or in either of the angularly offset positions, A, B, a locking tooth 124 is matingly engaged in the notch 118, 120 or 122. The locking tooth 124 is part of a T-shaped locking member 126 which is located in the slot 105 defined between the top leg 102 and bottom leg 104, with the ends of the arms 128 of the T extending outward beyond the slot 105 and captured between an outer wall 130 of a collar 132 and a ring 134 fitting tightly within the collar 132, against the outer wall 130. The collar 132 thus keeps the locking member 126 between the legs 102 and 104. The collar 132 may be knurled, as shown at 137, to make it easy to grip.

Figure 12:
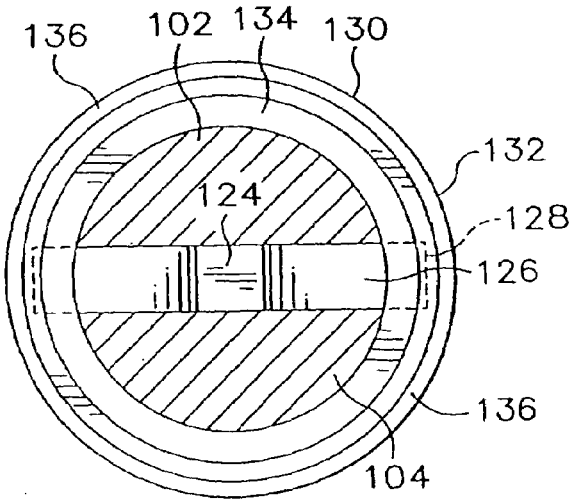
FIG. 12 is a view of the collar and locking member of the tool bit drive adaptor shown in FIGS. 1–11, taken in the direction of line 12—12 of FIG. 1.
Figure 13:
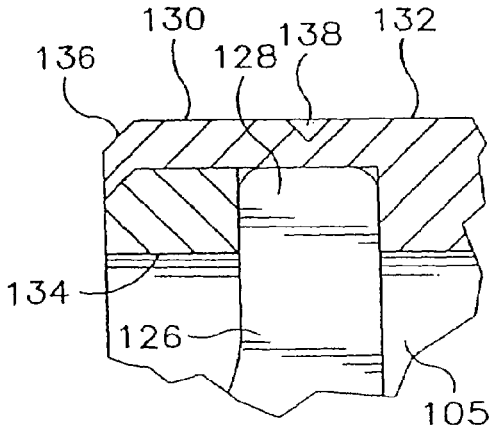
FIG. 13 is a detail, at an enlarged scale, of the collar and locking member shown in FIG. 11.

The collar 132 and ring 134 as a unit are slidably disposed about the tool bit-engaging member 22, but are prevented from moving with respect to one another or with respect to the locking member 126, as by the margin of the outer wall 130 being crimped inward against the ring 134 at 136, as shown in FIGS. 12 and 13, so that the ends of the arms 128 are caught between the ring 134 and the collar 132, and the collar 132 is not free to rotate about the tool bit-engaging member 22. For a more secure grip on the ends of the arms 128 the collar 132 could also be punched inward as shown at 138. A helical spring 140 is disposed within a longitudinal bore located between the legs 102, 104 and extends centrally along the tool bit-engaging member 22, as shown in FIG. 11, to urge the locking member 126, and with it the collar 132 and its associated ring 134, toward the screw 106. The spring 140 thus urges the locking tooth 124 into engagement with a respective one of the notches 118, 120, 122 when the tool bit-engaging member 22 is located at a corresponding angle 112 with respect to the drive plate 24. Preventing the collar 132 from rotating with respect to the tool bit-engaging member 22 makes it easier to push the collar 132 longitudinally along the tool bit-engaging member 22 to disengage the locking tooth 124 from one of the notches 118, 120 or 122.

Figure 14:
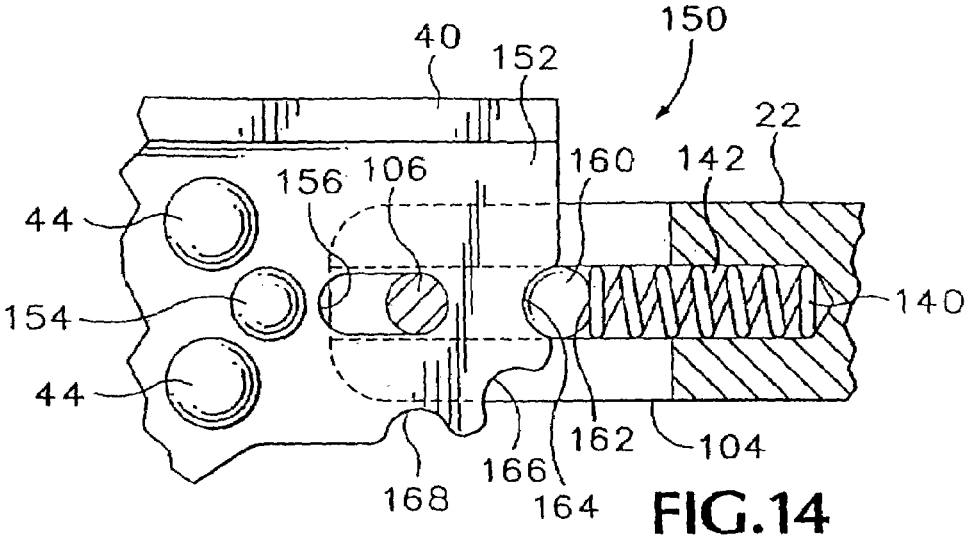
FIG. 14 is a view similar to FIG. 11, but showing the corresponding portion of a tool bit drive adaptor which is an alternative embodiment of the present invention.
Figure 15:
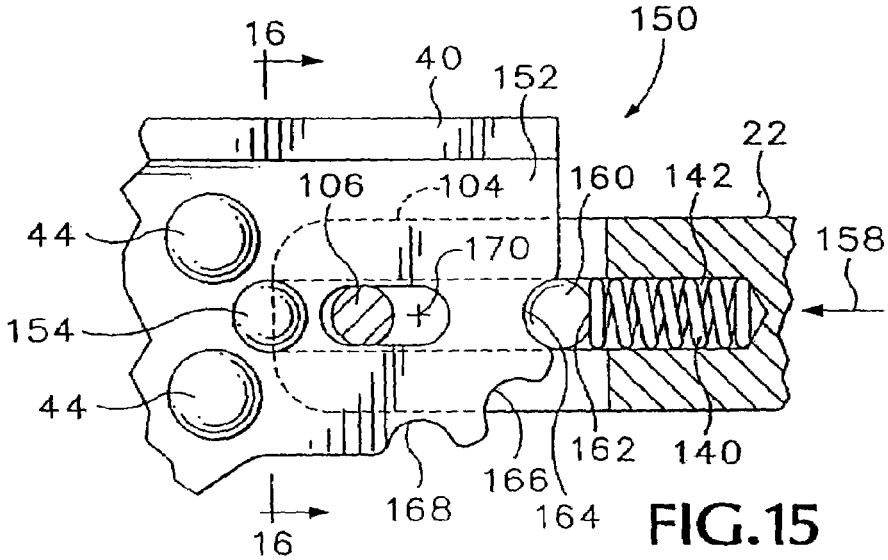
FIG. 15 is a view similar to FIG. 14, showing the portion of a tool bit drive adaptor shown in FIG. 14 with its tool bit-engaging member in a locking position with respect to the adaptor drive plate.
Figure 16:
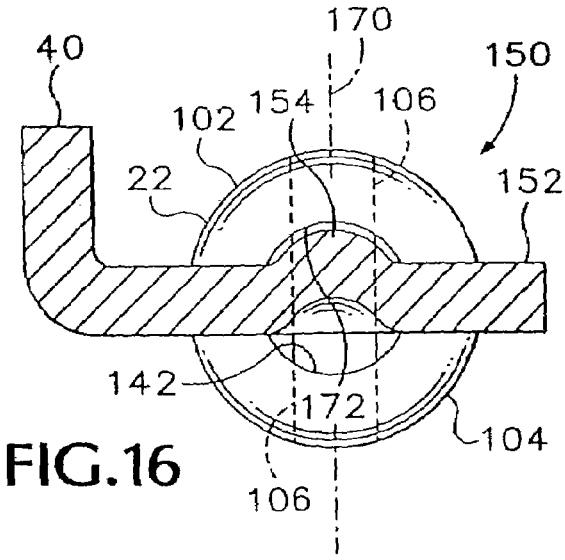
FIG. 16 is a section view taken along line 16—16 of FIG. 15.

In a tool bit drive adaptor 150 which is an alternative embodiment of the present invention, as shown in FIGS. 14, 15, and 16, a drive plate 152 includes a locking body 154, which may be a raised bump formed in the drive plate 152 by appropriate means, similar to formation of the spacer bumps 44. A pivot hole 156 extends through the drive plate 152 and is elongated, allowing the screw 106 in the tool bit-engaging member 22 to move longitudinally along the drive plate 152 in response to axial pressure in the direction indicated by the arrow 158 shown in FIG. 15.

A ball 160 is located within the bore 142 in the tool bit-engaging member 22, in contact with the outer end 162 of a spring 140, which urges the ball 160 toward the margin of the drive plate 152. Substantially semicircular detent notches 164, 166, and 168 are defined by the margin of the drive plate 152, in an in-line position, a 45° offset angle position, and a 90° offset angle position with respect to a central axis of rotation 170 located at an outer end of the pivot hole 156. The combination of the spring 140, the ball 160, and the detent notches 164, 166, and 168 permits the tool bit-engaging member 22 to be pivoted with respect to the drive plate 152 in much the same way as it can be pivoted with respect to the drive plate 24 described previously. At each of the positions established by the detent notches 164, 166, 168, the ball 160 is urged into the respective notch by the spring 140, tending to retain the tool bit-engaging member 22 in that position of rotation with respect to the axis 170.

Furthermore, when the tool bit-engaging member 22 is in the in-line position shown in FIGS. 14 and 15, it can be moved axially toward the drive plate 152, thus moving the screw 106 within the pivot hole 156 while compressing the spring 140. As this occurs a receptacle in the form of a channel or groove portion 172 (partially defining the bore 142) defined in the top leg 102 of the base portion 100 of the tool bit-engaging member 22, passes over and receives the locking body 154 as indicated in FIGS. 15 and 16. With the locking body 154 thus located within the channel portion 172, as shown in FIG. 16, the locking body 154 cooperates with the spring-loaded detent ball 160 in the detent notch 164 and with the screw 106 located within the pivot hole 156 to prevent the tool bit-engaging member 22 from pivoting with respect to the drive plate 152, thus effectively preventing the tool bit-engaging member 22 from moving out of alignment with the drive plate 152 when the tool bit drive adaptor 150 is in use and sufficient axial pressure is applied through a tool bit to overcome the force of the spring 140.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In combination with a hand tool including a pair of handles and a pair of pivotally interconnected members each having a base about which a respective one of said handles is movable between an extended position and a folded position, portions of said pivotally interconnected members being housed within said handles, and said handles both being in said folded position, a drive adaptor for driving a tool bit, the drive adaptor comprising:

(a) a drive plate having a driven end, a driving end, and opposite top and bottom faces, said driven end defining a fork having a pair of substantially parallel arms extending generally longitudinally of said drive plate, said fork arms being spaced apart from each other and defining a throat, said fork arms extending between the ones of said pair of handles, and a respective portion of each of said pivotally interconnected members being in contact with a respective one of said top and bottom faces; and (b) a tool bit-engaging member including a socket, attached to said drive plate at said driving end thereof and adapted to receive a tool bit.

2. The combination of claim 1 wherein portions of said pivotally interconnected members are located between said fork arms.

3. A drive adaptor, for use together with a hand tool having a pair of handles and a pair of jaws to drive a tool bit, the adaptor comprising:

(a) a drive plate having a driving end and an oppositely located driven end, said driven end including a pair of spaced-apart fork arms extending generally longitudinally of and generally in line with said drive plate and defining between said fork arms an open and substantially unobstructed throat, said drive plate including a side and having a stiffener portion extending longitudinally along said side and along a respective one of said fork arms; and (b) a tool bit-engaging member attached to said drive plate at said driving end thereof.

4. The drive adaptor of claim 3 wherein said tool bit-engaging member defines a socket for receiving a tool bit.

5. The drive adaptor of claim 3 wherein said tool bit-engaging member is movable with respect to said drive plate between an in-line position and an angled position.

6. The drive adaptor of claim 5 wherein said tool bit-engaging member is attached to said driving end of said drive plate by a pivot and is held in a selected one of said positions by a normally-engaged locking mechanism.

7. A drive adaptor for use with a hand tool and including a locking mechanism for holding a pair of members of said drive adaptor in a desired orientation with respect to each other, comprising:

(a) a drive plate having a driving end and an oppositely located driven end;

(b) a pivot pin mounted at said driving end and defining a pivot axis adjacent said driving end;

(c) a tool bit-engaging member drivably attached to said drive plate by said pivot pin and movable about said pivot axis with respect to said drive plate, said tool bit-engaging member having a pair of opposite ends, a first one of said opposite ends thereof being interconnected with said drive plate and a second one of said opposite ends thereof including a tool bit-engaging device;

(d) a locking member engageable with said margin, said locking member being movably disposed in said slot; and (e) a spring located within said tool bit-engaging member urging said locking member along said slot toward said drive plate and thereby urging said locking member into engagement with said margin, said locking member being manually movable away from said pivot axis by overcoming said spring, to disengage said locking member from said margin and permit said tool bit-engaging member to be pivoted about said pivot axis to a different angle with respect to said drive plate.

8. The drive adaptor of claim 7 wherein said first one of said opposite ends of said tool bit-engaging member has a pair of legs defining a slot between them, and wherein said pivot pin interconnects said legs with said drive plate at said pivot axis.

9. The drive adaptor of claim 3 wherein said drive plate is formed of a unitary piece of metal and said stiffener is a portion of said drive plate formed to extend along said side substantially normal to a main part thereof.

* * * * *